US006471098B1

(12) United States Patent
Shiau

(10) Patent No.: US 6,471,098 B1
(45) Date of Patent: Oct. 29, 2002

(54) STRUCTURE OF ADHESIVE DISPENSER

(76) Inventor: Shi-Lin Shiau, 3F-7, No. 66, Sec. 3, Pei-Ping Rd., Taichung (TW), 406

( * ) Notice: Subject to any disclaimer, the term of this patent is extended or adjusted under 35 U.S.C. 154(b) by 19 days.

(21) Appl. No.: 09/612,842

(22) Filed: Jul. 10, 2000

(51) Int. Cl.[7] ..... B67D 5/42

(52) U.S. Cl. ..... 222/391; 222/145.1; 222/336; 604/191

(58) Field of Search ..... 222/145.1, 145.5, 222/137, 391, 336, 340, 145.6, 145.3, 386, 327; 604/191, 207

(56) References Cited

U.S. PATENT DOCUMENTS

| | | | | | |
|---|---|---|---|---|---|
| 795,713 | A | * | 7/1905 | Letts | 222/137 |
| 1,672,421 | A | * | 6/1928 | Negley | 222/137 |
| 2,750,900 | A | * | 6/1956 | Moore | 222/145.1 |
| 3,750,913 | A | * | 8/1973 | Wild | 222/387 |
| 4,366,919 | A | * | 1/1983 | Anderson | 222/137 |
| 6,164,348 | A | * | 12/2000 | Rodwell | 141/382 |

FOREIGN PATENT DOCUMENTS

| | | | | |
|---|---|---|---|---|
| FR | 669 577 A5 | * | 3/1989 | 222/145.5 |

* cited by examiner

*Primary Examiner*—William Doerrler
*Assistant Examiner*—M A Cartagena

(57) ABSTRACT

The invention is related to the structure of an adhesive dispenser that is composed of an outer tube with a push rod and a handle. The apparatus uses a certain number of elastic elements to make relative displacement between push rod and outer tube, while it uses the locking end of the push rod and cotter groove to perform functions like locating, acceleration and stepwise movement, which makes easy operation for the users. Moreover, in the apparatus the outer tube can be equipped with an inner tube. So the spacing between inner tube and outer tube provides a mechanism that the sealant and adhesive filled in-between the inner and outer tube will flow out and mix under the motion of the push rod. This mechanism will not only facilitate sealing, adhesion and hardening prevention, but will also provide reusability.

8 Claims, 16 Drawing Sheets

STRUCTURE OF ADHESIVE DISPENSER

BACKGROUND OF THE INVENTION

The invention is related to a structure of adhesive dispenser, particularly an adhesive dispenser having inner, outer tube and associated with push rod for filling of sealant and adhesive gels. Upon the dispenser's structure, more than one sealant and adhesive gels in the dispenser can flow out separately then mixed, this increasing the completion of the mixture and prevents sealant/adhesive gels in the dispenser from improper cure. Further, by equipped with handle and locking design, the handle will facilitate the control of the stepwise movement of the push rod and increase its pushing force to achieve excellent performance.

General sealant and adhesive gels such as two-component gel (in "AB gel" hereafter) needs appropriate dispenser in application for applying/filling the sealant and adhesive gels to object position. The conventional dispenser, as illustrated in FIG. 1, is mainly composed of an outer tube (11), a push rod (12), a certain number of elastic members (13) and a filling head (14). One end of the outer tube (11) has screw thread (111) and bulge blade (112), and the other end have cotter groove (113) and cotter (114). The push rod (12) has toothed groove (121) in the axial direction with bulge blade (122) at one end. To insert the push rod (12) in the outer tube (11) and toothed groove (121) corresponds to cotter groove (113) also connects elastic member (13) with the bulge blades (112), (122). Finally, the dispenser is assembled by locking the filling head (14) with the screw thread (111) on one end of the outer tube (11).

When in application, premix the AB gel outside the above assembled dispenser then put the mixture of AB gel in the dispenser's outer tube (11). Then place the filling head (14) at object position, by elastic force of the elastic member (13) moves the push rod (12) spontaneously, the AB gel mixture AB gel in outer tube(11) is injected out and applied at object position to complete the filling task. Although the above dispenser can accomplish the filling operation, it has some disadvantages as follows:

1. Since AB gel will cure in certain time period after mixed, it should be used out all the amount of mixed gel at one time. The conventional dispenser must get the AB gel premixed outside then put in the outer tube (11). When the mixing ratio is not proper, the performance will not be satisfactory and the mixed gel should be discarded. Re-mixing the gel costs both time and efforts. The rest of mixed gel in application will cure at last and must be discarded. If it remains in the outer tube (11) and cure with tube, the dispenser will be useless and to become a double waste. This is apparently a kind of waste in materials and apparatus, which needs to be improved.

2. The adhesion operation is best performed by dot-wise filling of the adhesive gel to the object position, which is made possible in conventional dispenser only by manually pulling and pushing the push rod (12) to make dot drop filling. It is apparently cause inconvenience during the application and needs to be improved.

3. When the sealing and adhesion process is interrupted during mixed gel injection application, although the outer tube (11) has the cotter groove (113) and the cotter (114) for toothed groove (121) locking and then the push rod (12) will be blocked, it must be performed by worker's both hands. Moreover, due to the elastic force from elastic members (13) acted on push rod (12), the sealant and adhesive gel are continuously injected out, it is not easy to stop the motion of push rod (12) in time. So the overflow of the sealant and adhesive gel outside the outer tube(11) after filling operation, this cause trouble to worker.

4. Due to different characteristics of the sealant and adhesive gels, the viscosity of gels then will also be different. Once the viscosity is too high to move the push rod (12) by the elastic force of elastic members (13), the worker has no other auxiliary mechanism on conventional dispenser to help to move the push rod (12) but manually push it. In this case, it is not just inconvenient for the worker to handle the dispenser by both hands but also pretty dangerous for worker working in high position without holding a fixed object to stabilize his body. The risk is so high for the worker using conventional apparatus.

5. During filling operation, when the worker grasps the outer tube (11) the elastic members (13) will also in hold at the same time. This definitely affects the force of elastic members (13) on push rod (12) and causes resistance in the movement of push rod (12). Hence the structure of conventional dispenser is not an ideal one and needs to be improved.

In view of the above issues, based on the years of working experience in developing and using the relevant products, the inventor has disclosed the invention that will improves the conventional apparatus and meet the requirements for practical use hereafter.

For better understand the invention with respect to its structural feature and function, a practical example is given below with detailed description of illustrations.

| | | | |
|---|---|---|---|
| (11) | outer tube | (111) | screw thread |
| (112) | bulge blade | (113) | toothed groove |
| (114) | cotter | (12) | push rod |
| (121) | cotter groove | (122) | bulge blade |
| (13) | elastic member | (14) | filling head |
| (21) | outer tube | (22) | filling head |
| (23) | passing hole | (24) | through hole |
| (25) | locking blade | (26) | groove rail |
| (27) | bulge blade | (28) | holding section |
| (291) | locating hole | (292) | locating hole |
| (293) | slope | (294) | slope |
| (31) | inner tube | (32) | passing end |
| (33) | cone | (41) | push rod |
| (42) | toothed groove | (43) | passing groove |
| (44) | inner plug | (45) | outer plug |
| (46) | bulge blade | (47) | outer plug |
| (48) | toothed slope | (52) | locking end |
| (51) | handle | (54) | axial pin |
| (53) | locking end | (56) | blocking blade |
| (55) | axial pin | (71) | spacing |
| (61) | elastic element | (82) | setting groove |
| (81) | mixing tube | (84) | mixing rod |
| (83) | mixing tube | (86) | inclined opening |
| (85) | mixing tube | | |

DETAILED DESCRIPTION OF THE INVENTION

Figure 1:
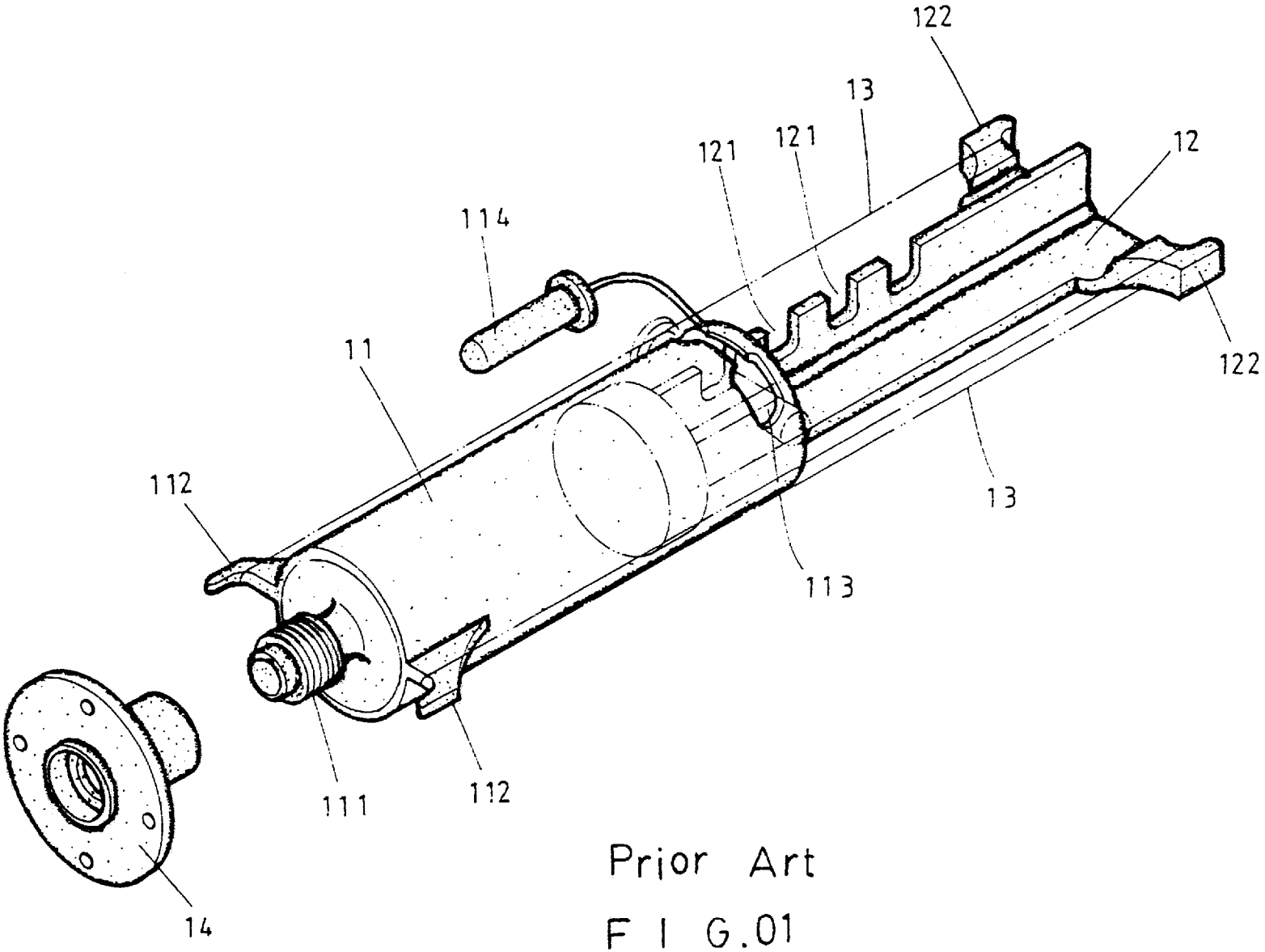
Prior Art FIG.01
FIG. 1: Configuration of Prior Art
Figure 2:
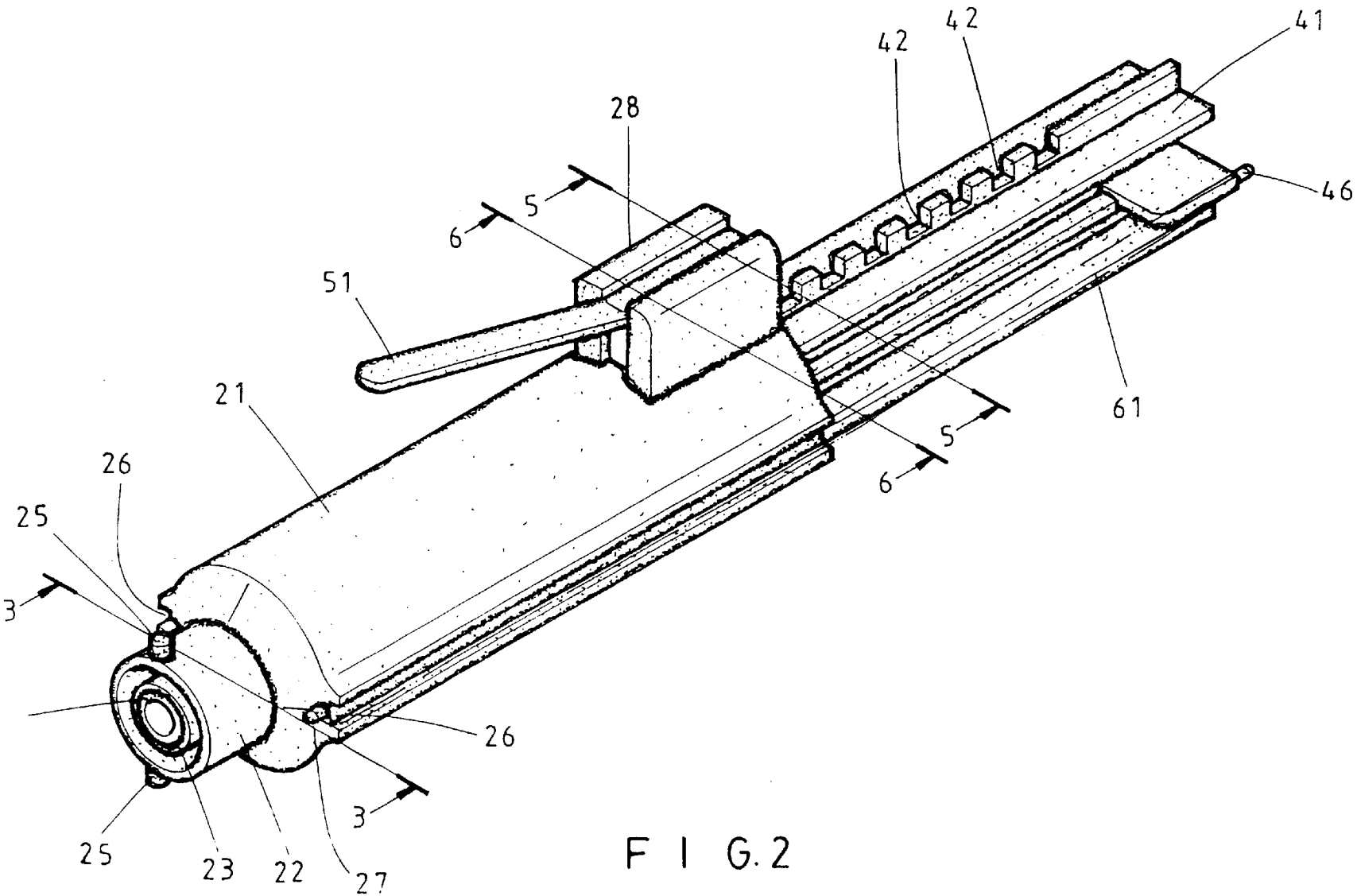
FIG. 2: Configuration of present invention
Figure 3:
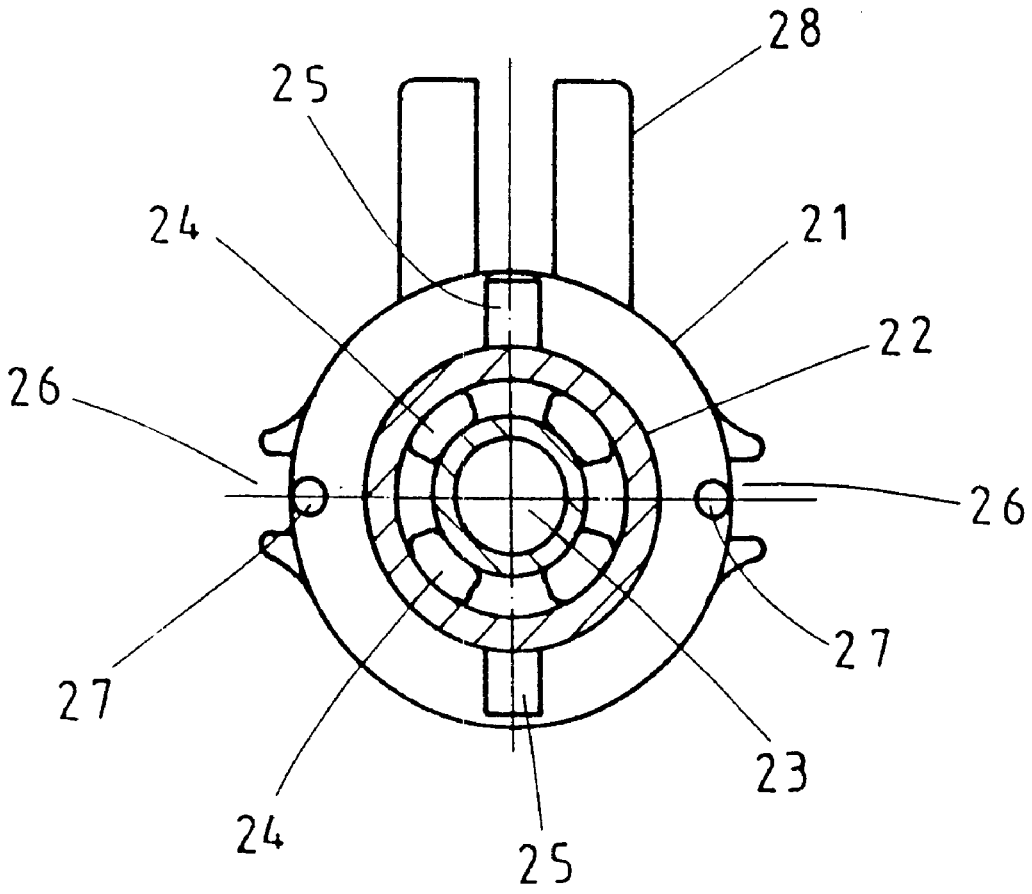
FIG. 3: Sectional View 3—3 of present invention
Figure 4:
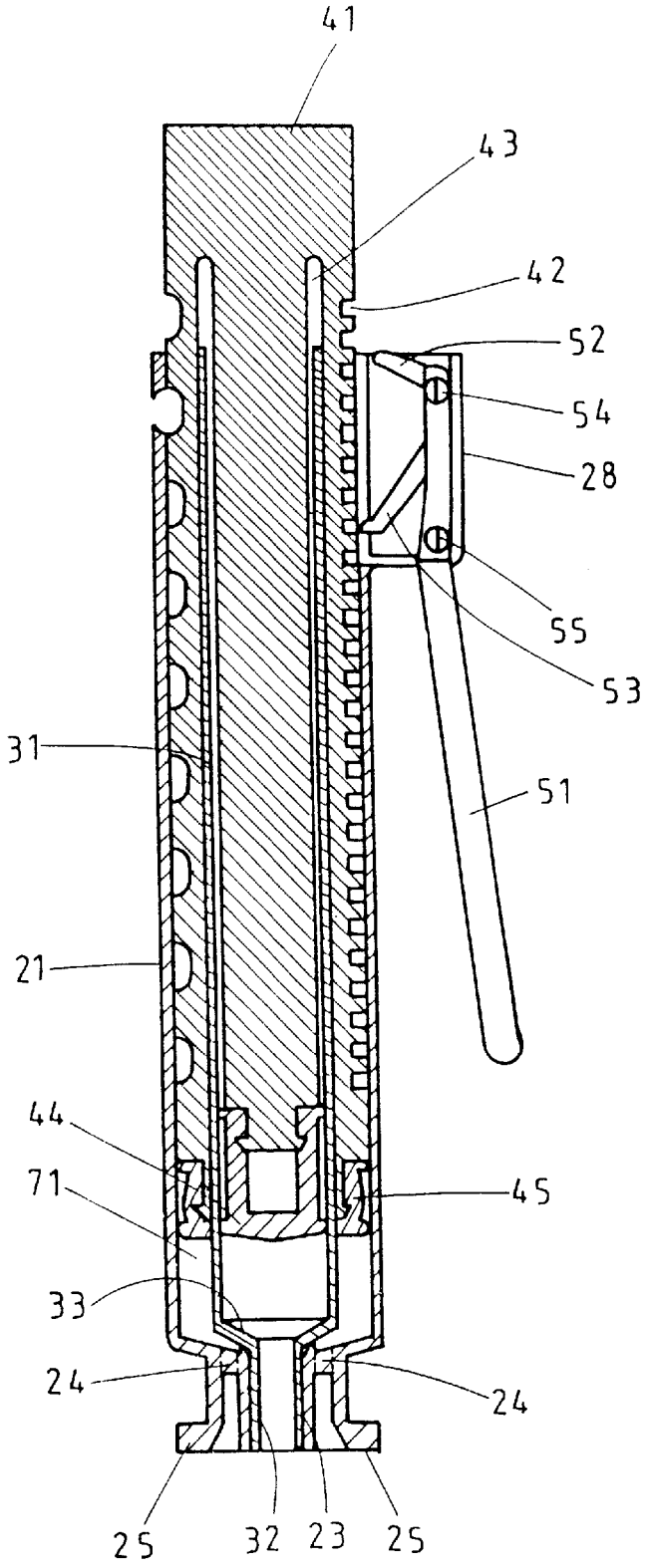
FIG. 4. Structural Illustration of present invention
Figure 5:
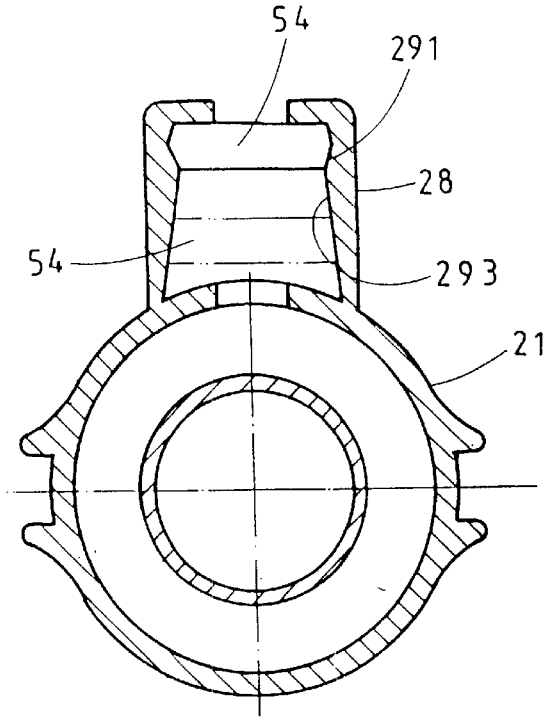
FIG. 5. Sectional View 5—5 of present invention
Figure 6:
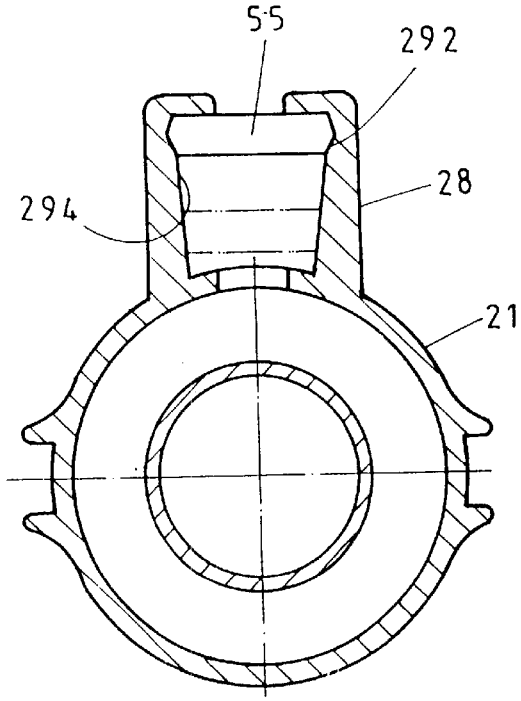
FIG. 6. Sectional View 6—6 of present invention

The invention is related to an adhesive dispenser, with reference to FIG. 2, FIG. 3 and FIG. 4, which is composed with an outer tube (21), an inner tube (31), a push rod (41), a handle (51) and a certain number of elastic elements (61). The outer tube (21) has a filling head (22) at one end with passing hole (23) at the center of inside in the axial direction. The filling head (22) has locking blade (25) outside. The outer tube (21) has corresponding groove rail (26) in the axial direction at outside of the main body. One end of grooving rail (26) has bulge blade (27). In addition, the outer tube (21) has a holding section (28) pointing out outside of the other end, with reference to FIG. 5 and FIG. 6. The holding section (28) has locating hole (291), (292) at upper two ends of the inner wall. The locating holes (291), (292) have slope (293) with narrow top and wide bottom or slope (294) with wide top and narrow bottom.

The inner tube (31) is axially all the way through the passing end (32). Cone (33) is formed at the connection of passing end (32) and main body. Based on this, the inner tube (31) passes through the outer tube (21) axially with its passing end (32) penetrating through the passing hole (23) of the filling head (22) and its location fixed by the support of the cone (33). Therefore a defined spacing (71) is formed between the inner tube (31) and the outer tube (21).

The push rod (41) is formed in predetermined shape and has toothed groove (42) of a certain number of teeth in the axial direction. The two corresponding sides have passing groove (43) in the axial direction. At one end of the push rod (41) have inner plug (44) and outer plug (45), and bulge blade (46) at the other end. Thus , when the push rod .(41) is put in the outer tube (21), the passing groove (43) is used for inner tube (31) to penetrate. The outer plug (45) is placed in the spacing (71) while the inner plug (44) is placed in the inner tube (31). By rotating the push rod (41) to adjust its angle, the toothed groove (42) will be corresponded to the holding section (28) of the outer tube (21) and the bulge blade (46) of the push rod (41) will correspond to the bulge blade (27) of the outer tube (21).

The handle (51) has long shaft at one end and two locking ends (52), (53) and two axial pins (54), (55) on the other end. The handle (51) is placed in the holding section (28) of outer tube (21). Please also refer to FIG. 5 and FIG. 6, the two axial pins (54), (55) can be respectively locked into the locating holes (291), (292) on the inner wall of holding section (28), and will not loosen due to the restrain of outer wall of holding section (28).

As to the elastic element (61), it can be elastic member or any long belt or ring belt with elasticity. Its one end connects with bulge blade (27) of the outer tube (21) and passes through the groove rail (26) of the outer tube (21), while the other end connects with the bulge blade (46) of the push rod (41).

Figure 7:
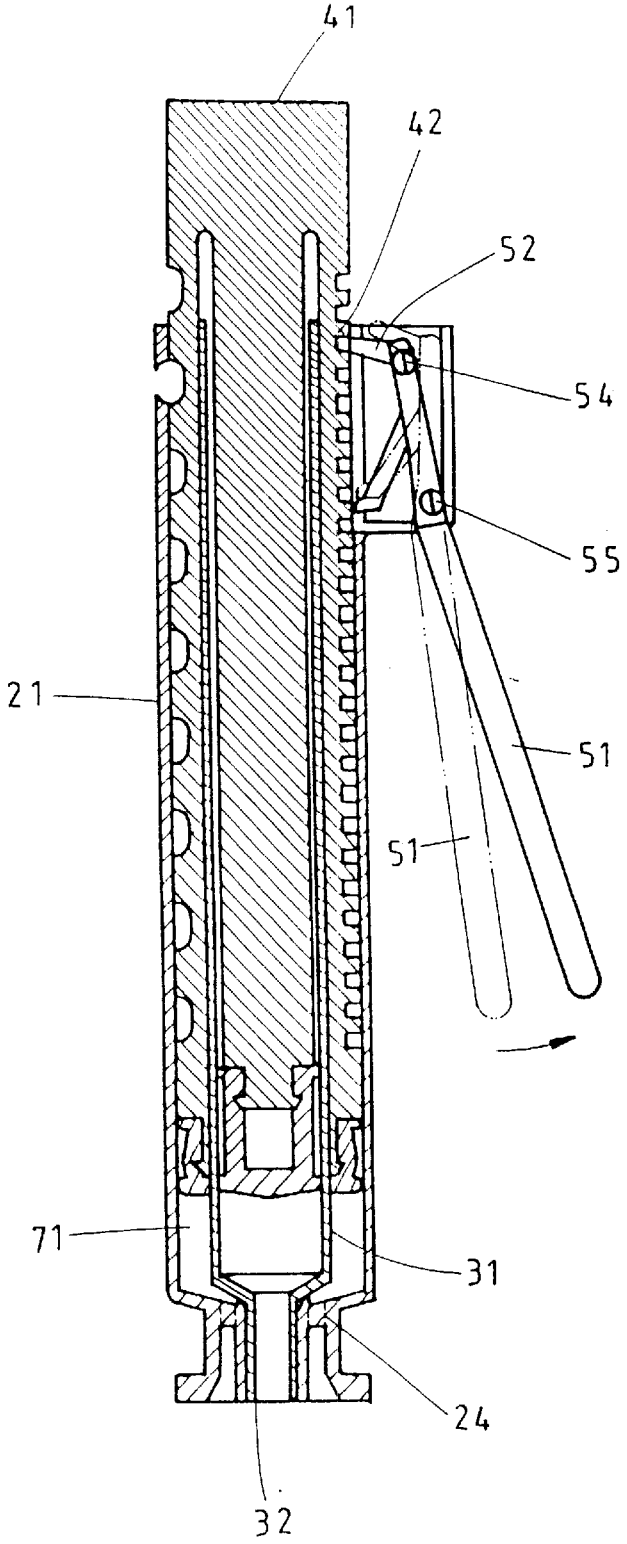
FIG. 7. Illustration of Operational Action for present invention

When in use, please refer to FIG. 7, mixing type sealant and adhesive gel, like AB gel, is respectively put in the inner tube (31) and in the spacing (71). The handle (51) is turned towards outside (as the direction shown in the Figure), and swings with the axial pin (55) as axis, so the locking end (52) is locked to the toothed groove (42) of the push rod (41). Then please refer to FIG. 5. Another axial pin (54) of the handle (51) enters into the slope (293) having narrow top and wide bottom during swinging. When the operator releases the handle (51), the axial pin (54) subject to the force from the slope (293) will be pushed to approach to outer tube (21) and the locking end (52) will not leave the toothed groove (42). So the locating function of push rod (41) does not need to be worried.

When the worker grasps present invented dispenser in single hand, the elastic element (61) is placed in the groove rail (26) so that won't touch to the elastic element (61). By slightly hold the handle (51) closes to the outer tube (21) makes the locking end (52) leaves the toothed groove (42). The push rod (41) will moves due to the action of elastic element (61) and squeeze the sealant and adhesive gel from the inner tube (31) and spacing (71) through the passing end (24) of the inner tube (31) and the through hole (24) of the outer tube (21). Thus, by predetermining the ratio of gel volume at passing end (32) and total volume of through hole (24), the mixing ratio of different gels can be controlled precisely. So the excellent sealing performance will be achieved. And because the inner tube and outer tube are separated, so the rest unused gels are stored separately and will not cure without mixing. Thus present invention can save sealant and adhesive gel from cure and reusable next time, this apparently avoids any waste of materials and saves cost. Furthermore, with the immediate and continuous action of hold and release by hand (basically the axial pin is not locked into the locating hole), the push rod (41) moves stepwise to squeeze the sealant and adhesive in a tiny amount each time. The invention can provide better adhesion performance without any problem.

Figure 8:
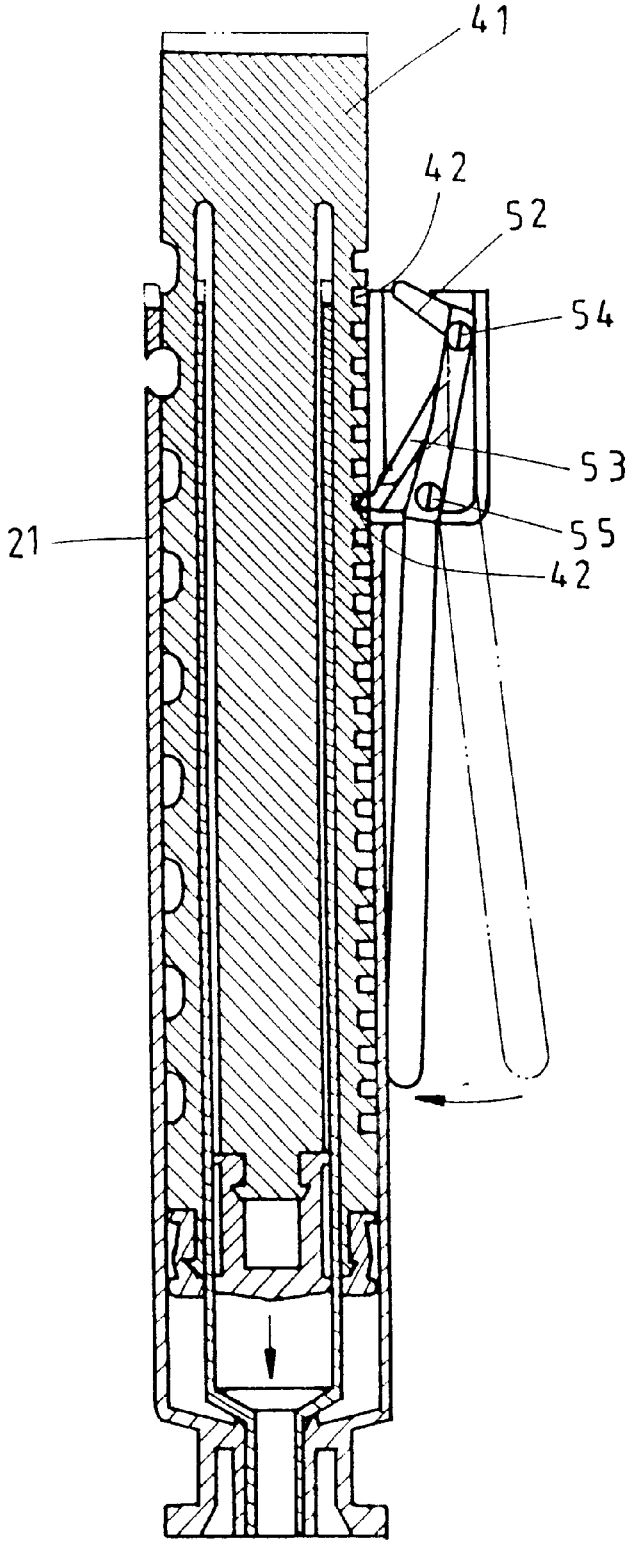
FIG. 8. Illustration of Another Operational Action for present invention

Again please refer to FIG. 6 and FIG. 8. When the worker holds the handle (51) close to the outer tube (21) (direction as shown in the Figure), the handle (51) will swing with the axial pin (55) as axis and the locking end (52) will leave the toothed groove (42). The other axial pin (55) will move to the position of the slope (294) having wide top and narrow bottom. Now the locking end (53) locks into the toothed groove (42). With the angle formed by locking end (53) and toothed groove (42), part of the grasping force is on the push rod (41). So the push rod (41) is subject to stronger force to move due to the elastic force from elastic element (61) and grasping action simultaneously. When the grasping action is released, axial pin (55) moves due to partial force from the slope (294). The locking end (53) leaves the toothed groove (42) and one more grasping action makes stronger force for the push rod (41). Therefore when using the sealant and adhesive gel has high viscosity, the dispenser in present invention still can extrudes and injects the sealant and adhesive gel step by step with above auxiliary force and does not have any problem in practical use.

In sum of above description, the present invention has outer tube (21) and inner tube (31), the sealant and adhesive gels be mixed after being extruded out from each storage in dispenser. It does not like conventional dispenser need to mix the two-component gels before put in dispenser. The present invention will not cause curing due to the chemical reaction after mixing and discarding of dispenser will not happen. It has more value for practical use than conventional type. Further, in present invention only one-hand operation is capable to make the push rod (41) stepwise movement on the dispenser so the state of sealant and adhesive gel extrusion meet the practical need, even in the application of high viscosity sealant and adhesive gel, present invention still provides auxiliary force on push rod (41) extrusion by handle(51) hold and release operation.

Figure 9:
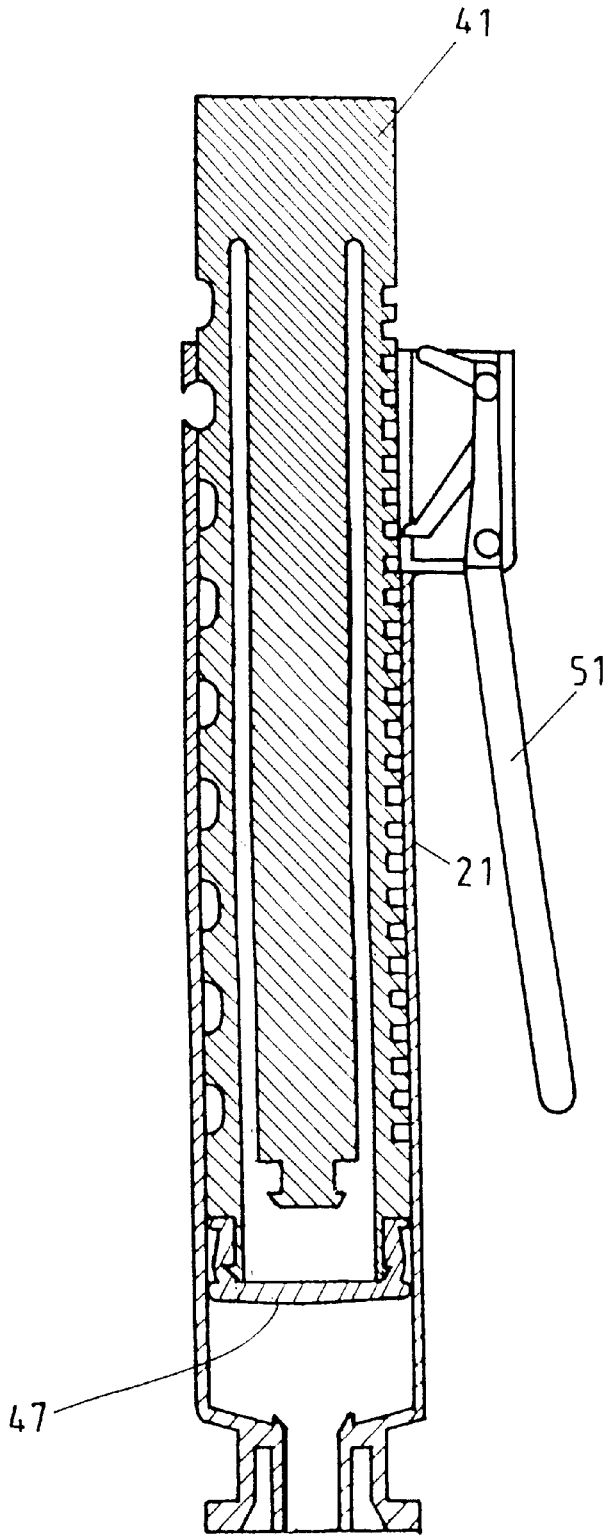
FIG. 9. Illustration of Single-Component Dispenser for present invention

In addition to previously mentioned assembly of outer tube (21) and inner tube (31) and the operational control by handle suitable for mixing type sealant and adhesive gels, present invention is also suitable for one-component sealant and adhesive gels, like silicone. Please refer to FIG. 9. There the push rod (41) is placed in the outer tube (21) and has closed type outer plug (47) at one end. According to this, the outer tube (21) has only one space, while the handle (51) and push rod (41) still have the function of stepwise movement control. So the dispenser in one-component gel application has similar performance with two-component gel for sealing and adhesion.

Figure 10:
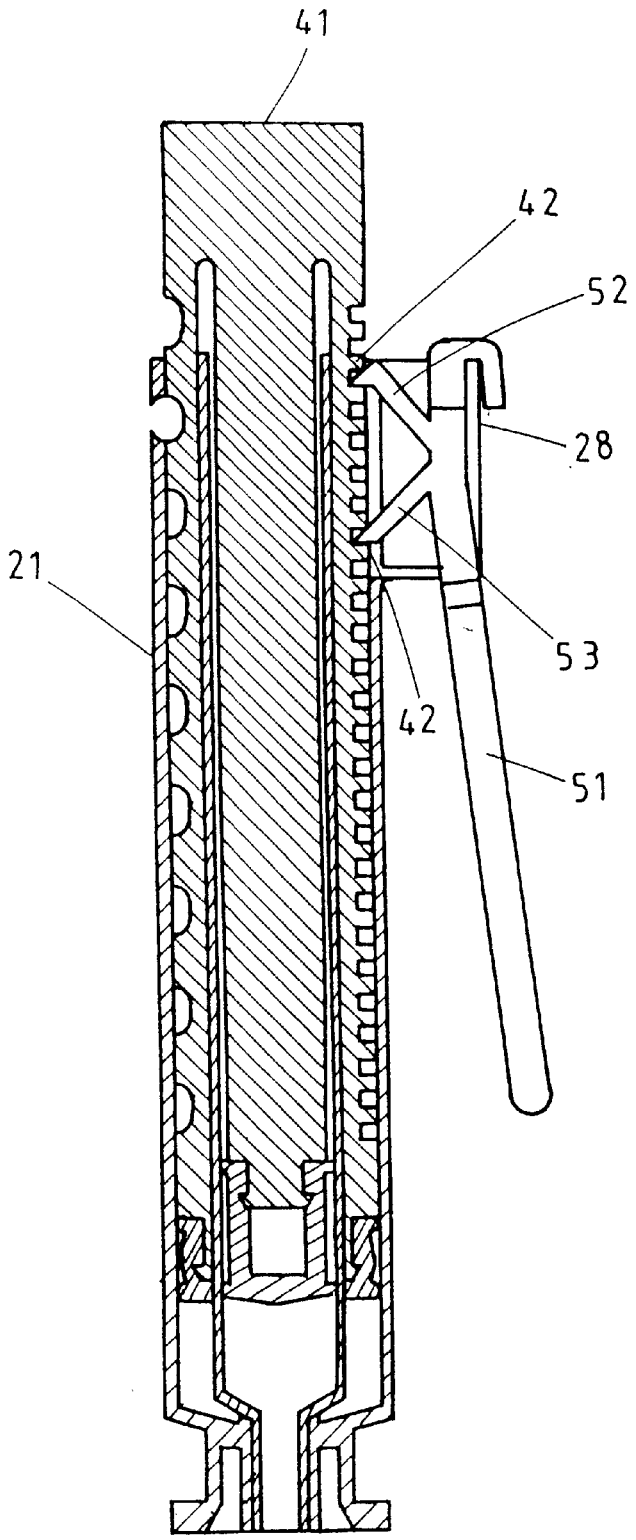
FIG. 10. Illustration of the Handle Structure in the Assembly for present invention FIG. 11. Illustration of Another Handle Structure in the Assembly for present invention FIG. 12. Configuration of the Mixing Tube for present invention FIG. 13. Structural Illustration of the Mixing Tube in the Assembly for present invention FIG. 14. Configuration of another Mixing Tube for present invention FIG. 15. Structural Illustration of Another Mixing Tube in the Assembly for present invention FIG. 16. Structural Illustration of Another Mixing Tube in the Assembly for present invention FIG. 17. Structural Illustration of Another Example for present invention

Furthermore, please refer to FIG. 10. In present invention, one end of the handle (51) can be locked in the holding section (28) of outer tube (21). Thus when hold the handle (51) with outer tube (21), one locking end (52) released from the toothed groove (42) while the other locking end (53) is still locked into the toothed groove (42), and the pushing force is generated by this mechanism, so the push rod (41) will extrudes the sealant and adhesive gel smoothly. When the release the handle (51) use the locking position with the holding section (28) as axis and return to the predetermined position by its own elasticity.

Figure 11:
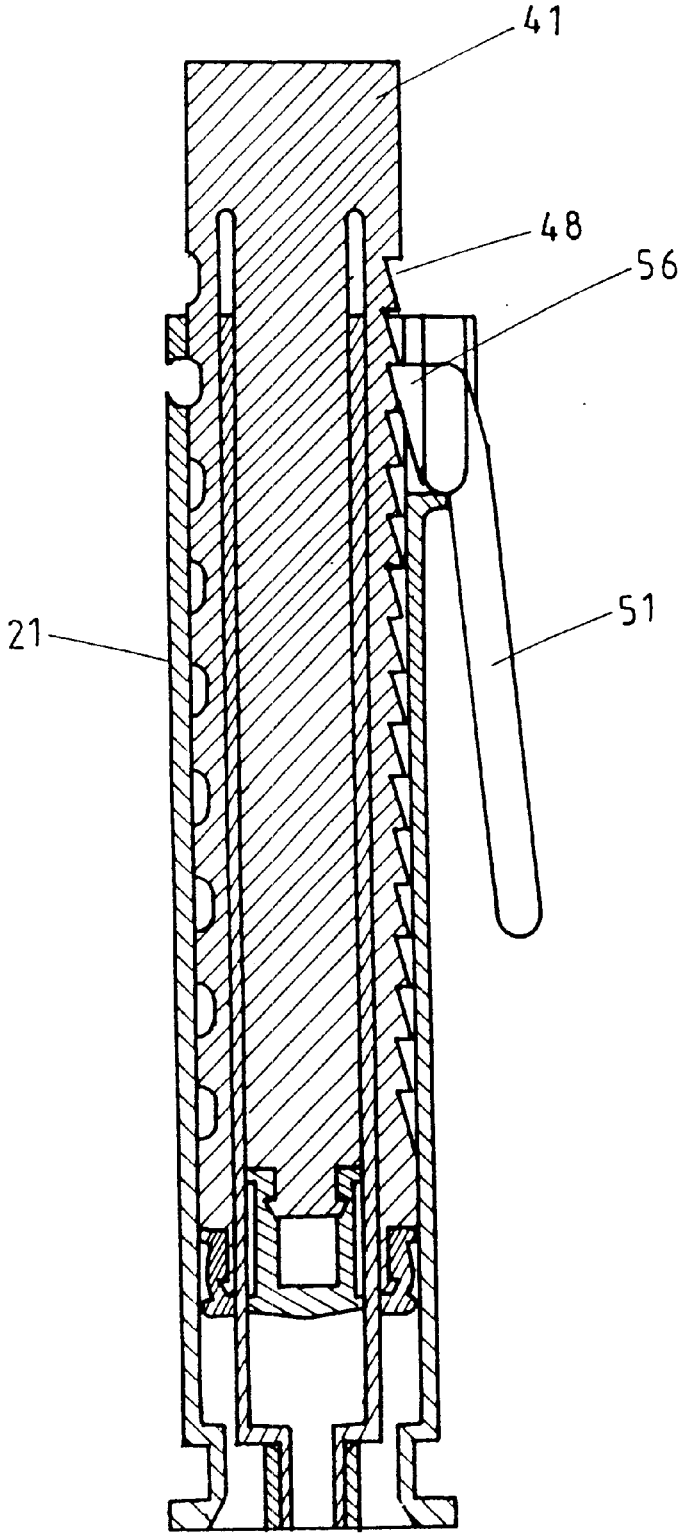

Furthermore, please refer to FIG. 11. In present invention, one end of the handle (51) can be made as blocking blade (56) and its corresponding toothed slope (48) is made on the push rod (41). Thus the match of the blocking blade (56) and the toothed slope (48) form a locking mechanism. During the hold operation on the handle (51), the blocking blade (56) leaves toothed groove (48) and the push rod (41) subject to force from elastic element (61) will extrude the sealant and adhesive gel, and the release will make handle (51) return to lock with push rod (41). So it still has the function of stepwise movement control.

Figure 12:
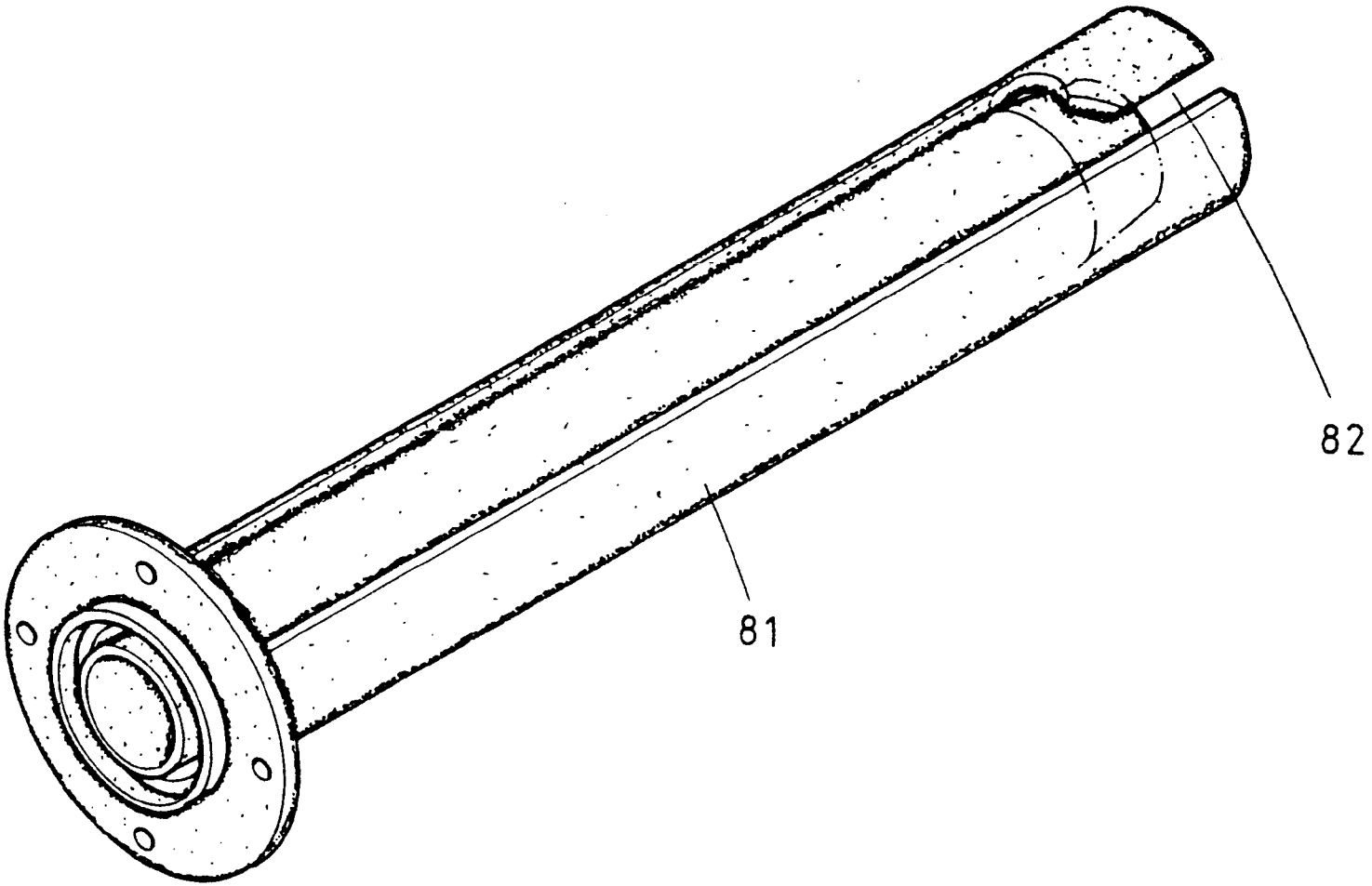
Figure 13:
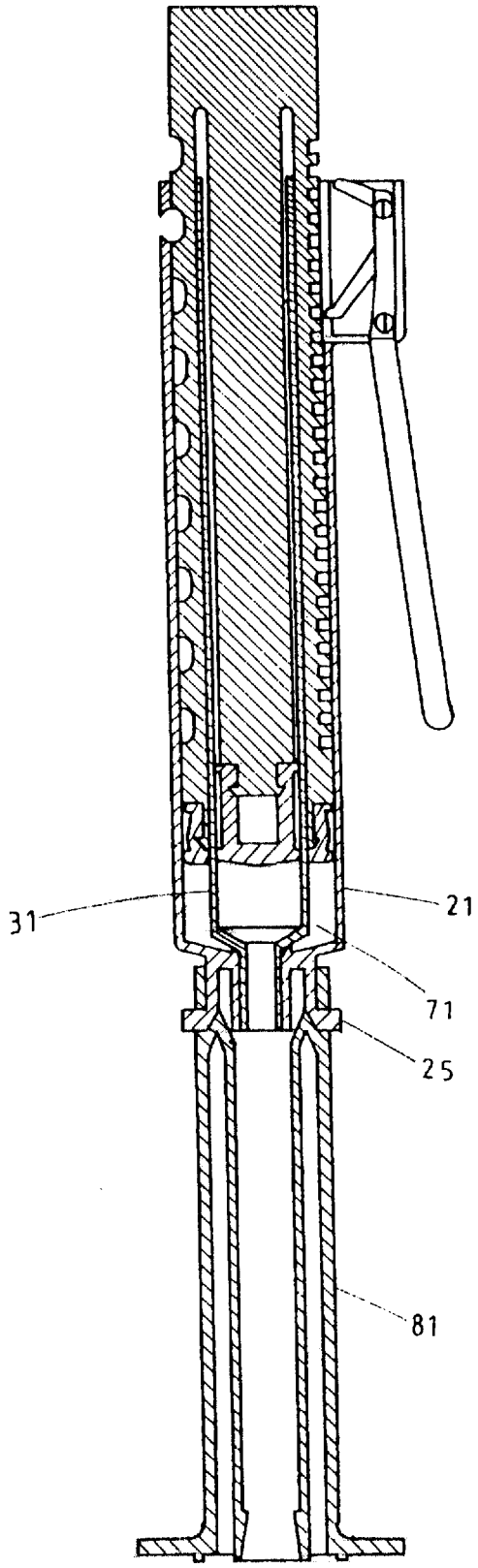

The previously mentioned sealant and adhesive gel placed between the inner tube (31) and the spacing (71) will be extruded out without any problem. Please refer to FIG. 12 and FIG. 13 showing the outer tube (21) has a gel mixing tube (81) at one end, which has the corresponding setting groove (82) on its surface and is hollow in the axial direction. Thus the locking blade (25) of outer tube (21) can be locked into setting groove (82). With proper rotation, the locking blade (25) connects with mixing tube (81) tightly. Now the sealant and adhesive from the spacing (71) and inner tube (31) enter into the mixing tube (81) together for mixing and further use.

Figure 14:
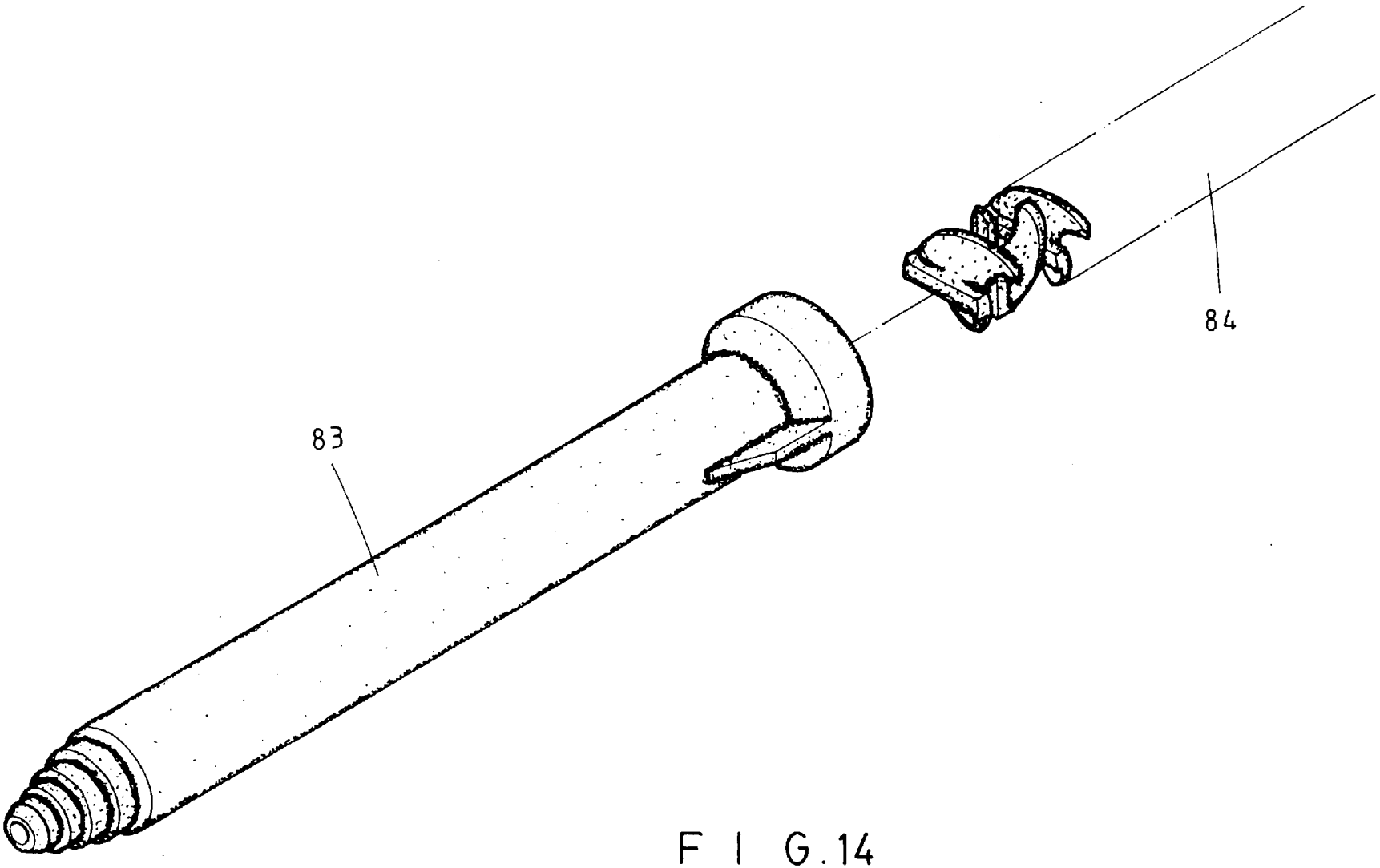
Figure 15:
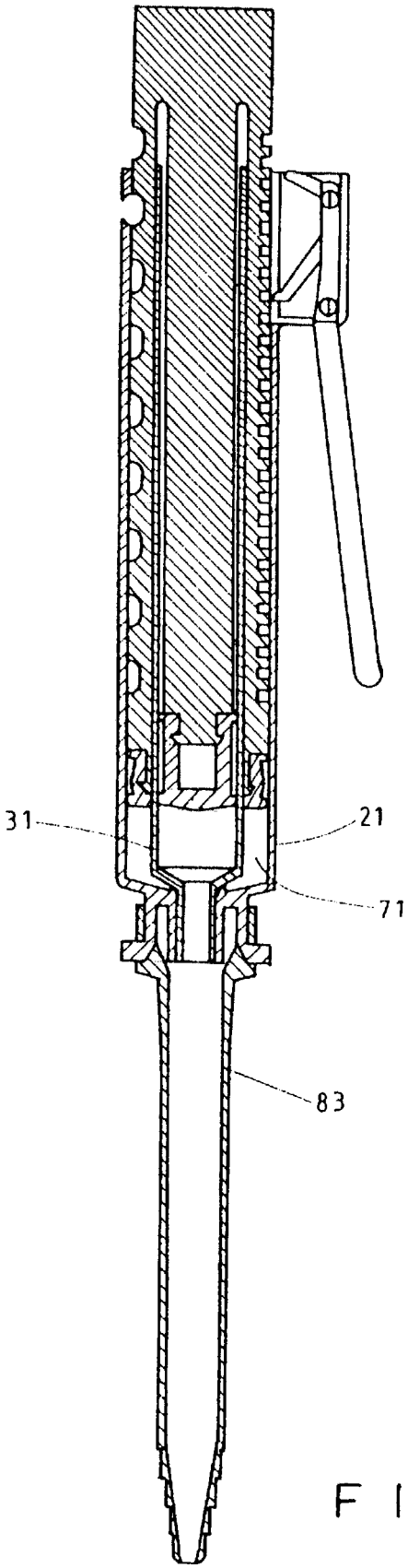
Figure 16:
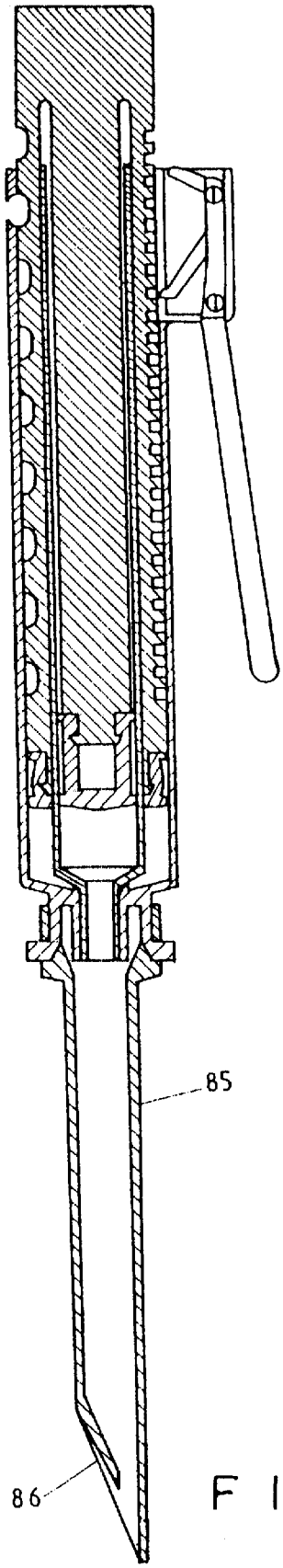

In addition, please refer to FIG. 14 and FIG. 15 for another type of mixing tube (83), which is placed at the other end of the outer tube (21) and has one mixing rod (84) inside. The mixing rod (84) has clockwise and counterclockwise helical structure arrangement, thus the sealant and adhesive between inner tube (31) and the spacing (71) flow along the angle of one helical structure respectively to the opening of mixing tube (83), where they mix together to fill to predetermined position. Further, please refer to FIG. 16, where the mixing tube (85) has an inclined opening (86) to spread the mixed sealant and adhesive on predetermined position.

Figure 17:
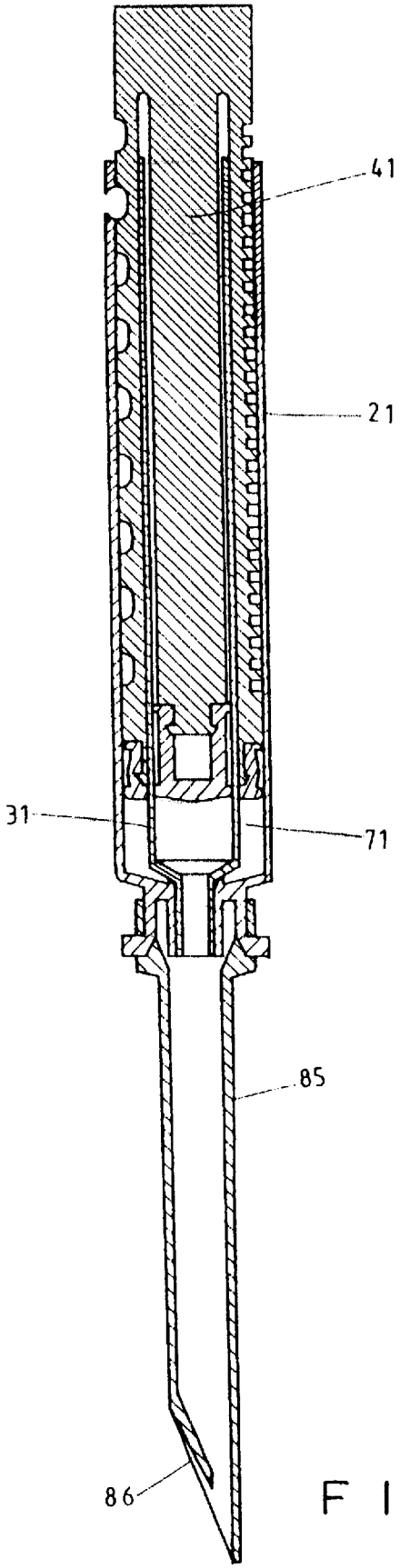

Furthermore, please refer to FIG. 17. In present invention, the outer tube (21) can be designed to have inner tube (31) inside with push rod (41) placed in the axial direction of outer tube (21) and inner tube (31), corresponding to the inside of inner tube (31) and the spacing (71). The outer tube (21) can have a mixing tube (85) at one end (also good for other type of mixing tube). The assembly structure can make the application of the mixed sealant and adhesive gel easier and also mix different sealant and adhesive gel well enough to provide satisfactory sealing and adhesion performance.

In conclusion, the present invention provides the separable assembly structure for the mixing type of sealant and adhesive gel to mix only prior to injection. So this can prevent any cure of the sealant and adhesive gel and also can save materials and apparatus cost. Moreover, with the structural design of the handle and the holding section, the handle can control over push rod for stepwise movement and can increase the pushing force on the push rod.

I claim:

1. A structure of adhesive dispenser, comprising an outer tube, having a filling head at an end thereof, at an axial center of said filling head being a passing hole, surrounding the passing hole being a through hole, the outer tube also having a holding section protruding from an exterior at another end thereof, a push rod, having a rod with a plurality of toothed grooves on one side along the axis thereof, installed inside the outer tube;

a specified number of elastic elements, having two ends attached respectively to the outer tube and the push rod, and capable of pulling the push rod to move by means of their elasticity;

a handle, having two different protruded locking ends at one end thereof, the handle being movably fitted onto the outer tube, the locking ends matching the toothed grooves on the push rod, thereby the handle can be controlled to engage different locking ends with different toothed grooves, to set the push rod in position, or produce stepped movement and increase its acting force.

2. The structure of adhesive dispenser as claimed in claim 1, wherein an inner tube is installed inside the outer tube, forming a clearance between the inner tube and the outer tube; the push rod having a passing groove along the axis thereof, at the ends of the push rod being respectively an inner plug and an outer plug, thereby when the push rod is installed inside the outer tube, the passing groove is inserted by the wall of the inner tube, the outer plug is located in the clearance, and the inner plug is located in the inner tube.

3. The structure of adhesive dispenser as claimed in claim 1, wherein, the holding section has locating hole at upper two ends of the inner wall, the locating holes have slope with narrow top and wide bottom or slope with wide top and narrow bottom, and the handle has two locking ends and two axial pins on one end, the handle is placed in the holding section of outer tube, the two axial pins can be respectively locked into the locating holes on the inner wall of holding section, and will not loosen by the restrain of outer wall of holding section, addition a mixing tube has corresponding setting groove on its surface, the locking blade of outer tube can be locked into the setting groove to integrate the mixing tube with the outer tube as one unit.

4. The adhesive dispenser as claimed in claim 3, wherein the locking blade of the outer tube can be installed outside the filling head at one end of the outer tube, to facilitate connection of the mixing tube.

5. The structure of adhesive dispenser as claimed in claim 1, wherein on the exterior along the axis of the outer tube can set with groove rails, at one end of the groove being a bulge blade, and on the push rod is also a bulge blade, thereby connect the elastic elements' two ends respectively with the bulge blades of outer tube and the push rod, and insert the elastic element in the groove rails.

6. The structure of adhesive dispenser as claimed in claim 3 or 4, wherein, the mixing tube can set one mixing rod inside it , on the mixing rod's surface being clockwise and counterclockwise helical structures next to each other, thereby enabling proper mixing after the sealant/adhesive gel starts to flow.

7. The structure of adhesive dispenser as claimed in claim 1, wherein the handle has a blocking blade, a surface of the push rod has a continuous toothed slope, thereby the blocking blade of the handle matches the toothed slope, forming a checking and positioning function to control the movement of the push rod.

8. The structure of adhesive dispenser as claimed in claim 1, wherein one end of the handle is hooked onto the holding section, protruding from a side surface being two locking ends to match the toothed grooves on the surface of the push rod inside the outer tube, thereby increasing an acting force on the push rod for control of accelerated movement of the push rod, when the handle is operated to engage the locking ends to the toothed grooves.

* * * * *